US006878236B2

(12) United States Patent
Tienvieri et al.

(10) Patent No.: US 6,878,236 B2
(45) Date of Patent: Apr. 12, 2005

(54) RAW MATERIAL FOR PRINTING PAPER, A METHOD FOR PRODUCING SAID RAW MATERIAL AND A PRINTING PAPER

(75) Inventors: Taisto Tienvieri, Valkeakoski (FI); Markku Gummerus, Tampere (FI)

(73) Assignee: Upm-Kymmene Corporation, Helsinki (FI)

( * ) Notice: Subject to any disclaimer, the term of this patent is extended or adjusted under 35 U.S.C. 154(b) by 0 days.

(21) Appl. No.: 10/165,192

(22) Filed: Jun. 7, 2002

(65) Prior Publication Data

US 2003/0015305 A1 Jan. 23, 2003

Related U.S. Application Data

(63) Continuation of application No. PCT/FI00/01055, filed on Dec. 1, 2000.

(30) Foreign Application Priority Data

Dec. 9, 1999 (FI) ..... 19992641

(51) Int. Cl.[7] ..... D21H 11/08; D21B 1/14; D21C 9/00; D21C 9/08

(52) U.S. Cl. ..... 162/156; 162/155; 162/20; 241/21; 241/24.1; 241/29; 241/30

(58) Field of Search ..... 162/20, 28, 55–56, 162/100; 241/21, 24.1, 28–30

(56) References Cited

U.S. PATENT DOCUMENTS

| | | | | | |
|---|---|---|---|---|---|
| 4,116,758 | A | * | 9/1978 | Ford et al. | 162/28 |
| 4,244,778 | A | * | 1/1981 | Lindahl et al. | 162/17 |
| 4,562,969 | A | * | 1/1986 | Lindahl | 241/21 |
| 4,718,980 | A | * | 1/1988 | Lowrie et al. | 162/78 |
| 4,776,926 | A | * | 10/1988 | Lindahl | 162/28 |
| 4,938,843 | A | * | 7/1990 | Lindhal | 162/55 |
| 4,966,651 | A | * | 10/1990 | Olson et al. | 162/28 |
| 5,145,010 | A | * | 9/1992 | Danielsson et al. | 162/26 |
| 5,394,600 | A | * | 3/1995 | Chen | 29/447 |
| 5,427,651 | A | | 6/1995 | Lindahl | |
| 5,582,352 | A | | 12/1996 | Bokstrom | |
| 5,607,546 | A | * | 3/1997 | Hoglund et al. | 162/25 |
| 5,799,798 | A | | 9/1998 | Chen | |
| 5,879,510 | A | * | 3/1999 | Hagglund et al. | 162/25 |
| 6,336,602 | B1 | * | 1/2002 | Miles | 241/28 |
| 6,361,650 | B1 | * | 3/2002 | Danielsson et al. | 162/28 |
| 6,458,245 | B1 | * | 10/2002 | Hoglund et al. | 162/149 |
| 2002/0088569 | A1 | * | 7/2002 | Bryant et al. | 162/63 |
| 2003/0006016 | A1 | * | 1/2003 | Tienvieri et al. | 162/20 |
| 2003/0015305 | A1 | * | 1/2003 | Tienvieri et al. | 162/56 |

FOREIGN PATENT DOCUMENTS

| | | |
|---|---|---|
| DE | 2714730 | 10/1977 |
| EP | 0138484 | 4/1985 |
| SE | 397851 | 11/1977 |

OTHER PUBLICATIONS

International Search Report for International application No. PCT/FI00/01054, mailed on Mar. 16, 2001.
International Search Report for International application No. PCT/FI00/01055, mailed May 17, 2001.
Printout from Dialog(R) File 351 is provided for Finnish publication which supplies relevant patent information, and English language title and abstract.

* cited by examiner

*Primary Examiner*—JoséA. Fortuna
(74) *Attorney, Agent, or Firm*—Fitch, Even, Tabin & Flannery

(57) ABSTRACT

The object of the present invention is a method for making mechanical pulp, such as thermomechanical or chemi-thermomechanical stock. The mechanical pulp is used as a raw material for printing paper, and its freeness value is 30–70 ml CSF. The stock refined by the method is screened in several stages to form accept and reject stock portions. The wood raw material is refined at the first stage of refining at a superatmospheric pressure of over 400 kPa to form a stock that has a freeness value of 250–700 ml CSF.

40 Claims, 5 Drawing Sheets

Figure 1:
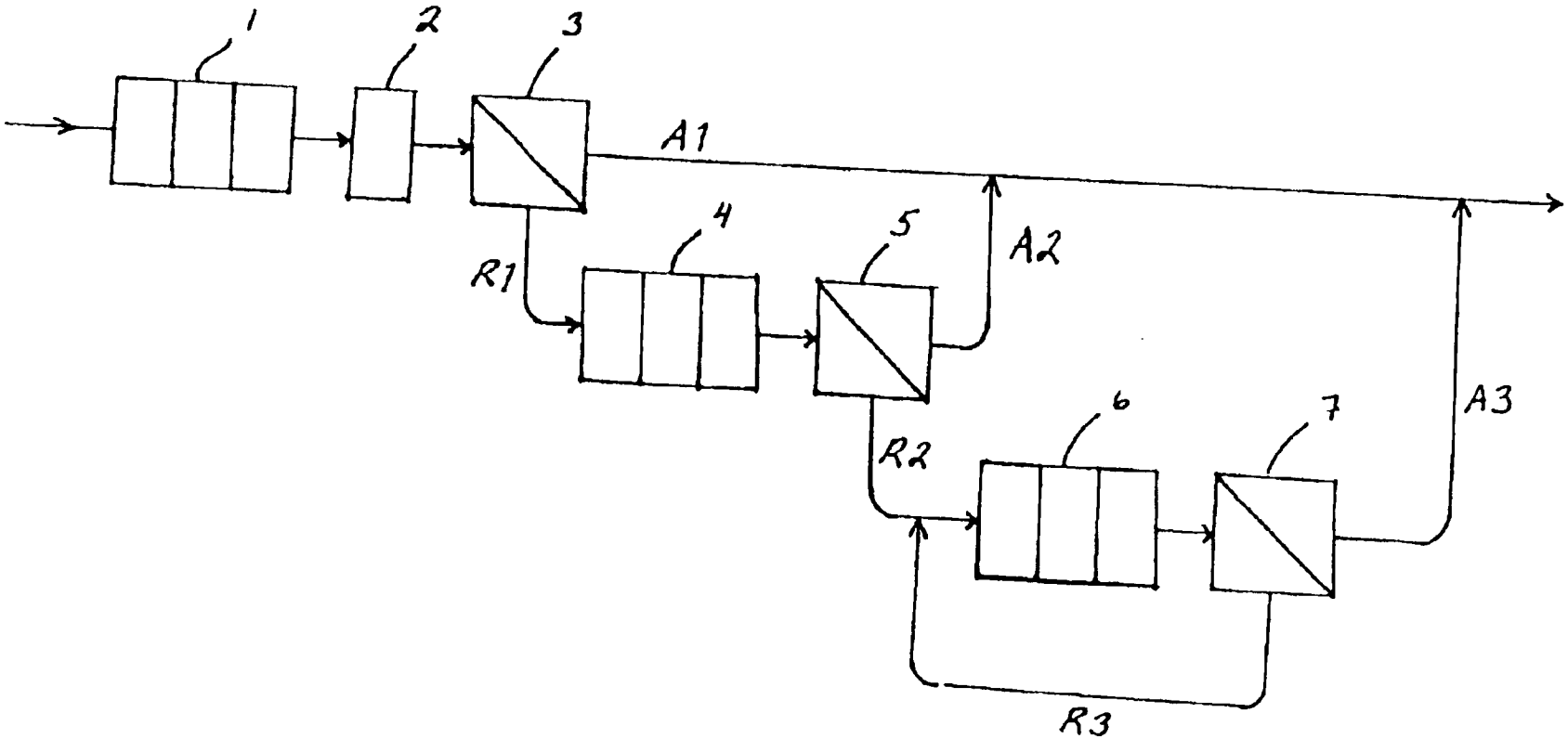

RAW MATERIAL FOR PRINTING PAPER, A METHOD FOR PRODUCING SAID RAW MATERIAL AND A PRINTING PAPER

This application is a CON of PCT/FI00/01055 Dec. 1, 2000.

The object of the present invention is a pulp stock, a method for preparing it, the use of the stock as a raw material for producing printing paper, especially newsprint, and a printing paper. The stock produced in accordance with the method of the present invention can be used as a raw material for producing different papers, such as SC paper (supercalendered) comprising both offset and gravure grades, coated paper of low grammage or LWC paper (light weight coated) comprising both offset and gravure grades, and newsprint or corresponding printing papers. Newsprint also comprises other grades of paper than those used in newspapers, e.g. catalogue papers and gravure papers.

A known method for producing mechanical pulp is presented in patent publication U.S. Pat. No. 5,145,010, corresponding to international application WO 8906717 and Swedish patent publication SE 459924. The method comprises the following phases:

- treating softwood chips with water and chemicals
- primary refining of the treated chips
- separating the refined softwood pulp into accept and reject stock portions, whereby the reject portion comprises 15–35% of the refined stock
- refining of the reject stock portion in two stages, whereby the stock consistency at the first stage is approximately 20–35% and at the third stage approximately 5%, and
- the above-mentioned stock is fractionated to form an accept stock portion and a reject stock portion.

A known method for producing mechanical pulp is presented in patent publication U.S. Pat. No. 4,938,843. The process involves the production of chemi-thermomechanical pulp. The chips treated with chemicals and heat are refined to a freeness value of 100–700 ml CSF, usually in a two-stage refining process and screened to form a first accept stock portion and a first reject stock portion, so that at least 30% of the stock goes into the reject stock portion. The first accept stock portion is screened for a second time, whereby a second accept stock portion and a second reject stock portion are obtained. The first and the second reject stock portions are combined, thereby producing a long-fibre fraction with a freeness value of 200–750 ml CSF, which can be used separately to produce coarse-fibred products, for example cardboard, or it can be further refined and returned to the first screening.

One known method is the method for preparing stock described in the introductory part of patent claim 1 of the present application, in which method the process begins with two-stage refining. The chips are fed into the first refiner, from which they are fed into the second refiner after the primary refining is complete. After the second refiner, the freeness value of the stock is about 120 ml CSF. The consistency is typically 50% at the first refiner and 45% at the second refiner. After the first refiner, the measured average fibre length, when using spruce as the raw material, is approximately 1.7 mm, and after the second refiner the average fibre length when using the same raw material, is approximately 1.5 mm. After the second refiner there is a latency chest, in which the fibres are straightened by diluting the consistency to 1–2%. The fibres are treated in the latency chest for one hour. The fibres are conveyed to the first screen, which screens the stock to form an accept portion and a reject portion. The freeness value of the accept stock portion is about 20 ml CSF. Water is removed from the reject stock portion until a consistency of 45% is reached. The reject stock portion, which comprises 40–50% of the total stock, is conveyed to a third refiner, from which the reject stock, diluted to a consistency of 1%, is transported on to a second screen. Again the stock is fractionated into an accept stock portion and a reject stock portion. The reject stock portion is conveyed, after removal of water, at a consistency of 45%, to a fourth refiner, and further diluted to a consistency of 1%, on to a third screen. The reject stock portion from this screen is fed again to the fourth refiner. The stock obtained from the process has a freeness value of 30–70 ml CSF. The pressure used in the refiners is 350–400 kPa. The process consumes about 3.3 MWh/t of energy (using spruce as the raw material), 0.3 MWh/t of which is used for regulating the consistency to a suitable level for every stage of the process.

In the state-of-the-art process mentioned above, the problems include high energy consumption, relatively short average fibre length of the obtained stock, and mainly due to this, deficiencies in the tensile strength and tear resistance of the printing paper produced from the stock. The above-mentioned problems can be reduced by the method of the present invention for producing stock, the stock itself, the use of the stock in producing printing paper and the printing paper itself.

The method of producing stock in accordance with the present invention is characterised in that the stock is refined in the first refining stage at a superatmospheric pressure of over 400 kPa (over 4 bar) to form a stock that has a freeness value of 250–700 ml SCF. The stock produced in accordance with the present invention is characterised in that at least 40% by weight of the fibres do not pass through a Bauer-McNett screen with a mesh size of 28. The printing paper produced in accordance with the present invention is characterised in that it has been made of stock that has been produced by the method according to the patent claims 1–35 and/or stock produced according to patent claim 40.

The basic idea of the stock preparation method in accordance with the present invention is to produce mechanical pulp stock in with a high relative proportion of long fibres. The term mechanical stock is used in this application to indicate stock produced by refining wood raw material, such as chips. In connection with the refining, the wood raw material and/or stock is heat-treated, in which case the process is that of producing thermomechanical pulp. The wood raw material may have also been treated with chemicals before refining, in which case the process is that of producing chemi-thermomechanical pulp.

Using this method it is possible to obtain an average fibre length that is 10% longer than in the methods known in the prior art. The relative proportion of short fibres remains more or less the same as in the prior art, but the proportion of medium length fibres decreases and the proportion of long fibres increases. Surprisingly it is possible to produce from said stock with high average fibre length, a paper with good formation and with properties that meet the high requirements for printing paper. Traditionally it has been difficult to achieve the properties of long average fibre length and stock with good formation in the same product, because no way has been known of refining fibres to the required degree of fineness while still retaining relatively high fibre length. Moreover, in the method of preparing stock according to the invention, the energy consumption is lower than in the known methods that aim at the same freeness value. In this patent application, freeness value refers to Canadian Standard Freeness, the unit of which is ml CSF. Freeness can be used to indicate the refining degree of the pulp. According to the literature, the following correlation exists between the freeness and the total specific area of the fibre:

$$A=-3.03\ln(\text{CSF})+21.3,$$ where $A$=total specific area of the pulp (unit $m^2/g$).

According to the above-mentioned formula, the total specific area of the pulp increases as the freeness decreases, i.e. the freeness gives a clear indication of the refining degree because, as the proportion of fines grows, the specific area of fibres increases.

Due to the relatively high proportion of long fibres in this stock produced from virgin (primary) fibres, printing paper manufactured from the stock has better tensile and tear properties. Thanks to the better strength properties, printing paper of lower grammage than before can be manufactured. In addition more fillers can be added to replace more expensive fibre and/or to give additional properties to the printing paper. For supercalendered paper, the filler content used can be approximately 30%, and for newsprint 7–15%, advantageously approximately 10%. Fillers reduce the strength of the paper but they are cheaper than fibre raw material and improve, for example, the light scattering coefficient and opacity of the paper.

The stock can be used to manufacture, for example, newsprint, with a grammage of 30–40 $g/m^2$, measured at a temperature of 23° C. and at a relative humidity of 50%. Important properties required of newsprint grades are runnability, printability and visual appearance. What is meant by good runnability is that the paper can be conveyed through a printing machine without breaks in the web. Paper properties affecting the runnability of paper include tear resistance, formation, tensile strength, elongation and variation in grammage.

Printability means the ability of the paper to receive the print and to retain it. Printing ink must not come off when rubbed, transfer from one sheet to another or show through the paper. Paper properties affecting the printability of paper include, for example, smoothness, absorbency, moisture content, formation, opacity, brightness, porosity and pore size distribution.

The visual appearance of the paper can be judged by its optical properties, such as brightness, whiteness, purity and opacity.

The tree species that have been presented in this application as suitable raw materials for use are spruce (*Picea abies*), pine (*Pinus sylvestris*) and southern pine (genus *Pinus*, several different species). It is also feasible that the stock made of wood raw material may contain stock obtained from at least two different tree species and/or stock prepared in at least two different ways, which at a suitable stage of preparation are mixed with each other. For example in supercalendered paper and in low-grammage coated papers, chemical pulp obtained by chemical cooking is generally one of the raw materials used, whereas it is not usually used in newsprint. The amount of chemical pulp in supercalendered paper is usually 10–20%, and in low-grammage coated papers 20–50% of the pulp composition. The pulp composition refers to the total fibre stock used for the manufacture of paper.

The preparation of stock by the method according to the invention comprises the primary refining of a suitable wood raw material and the following refining and screening stages. The so-called primary or first stage of refining is carried out at a high temperature of 165–175° C., and under a high pressure of 600–700 kPa (6–7 bar) for a short time, as a result of which the stock remains quite coarse. The average retention time of the raw material in the high-pressure refiner is only 5–10 seconds. The temperature at which refining takes place is determined by the pressure of the saturated steam.

The first stage of refining is advantageously a one-stage process. There may however be several parallel refiners at the same stage. After the first stage of refining, the stock has a freeness value of 250–700 ml CSF. After the first stage of refining the stock is screened so as to produce a first accept stock portion and a first reject stock portion. When the stock has been screened into a first accept stock portion and a first reject stock portion, there are different possible procedures for continuing the process, such as 1-step processing of the first reject stock portion, in which the reject stock portion is refined and screened in one step. Accept stock portions are taken out of the process after each stage of screening and/or accept stock portions are re-screened, or 2-step processing of the first reject stock portion, in which the reject stock portion is refined and screened in two steps. The accept stock portions are taken out of the process after each stage of screening and/or the accept stock portions are re-screened, or 3-step processing of the first reject stock portion, in which the reject stock is refined and screened in three steps and the accept stock portions are taken out of the process after each screening stage, or forward-connected 2- or 3-step processing of reject stock, which means the processing of the reject stock first in two or three steps and removal of the accept stocks after each screening stage, and thereafter the refining of the last reject stock portion, for example, in a low-consistency refiner and removal from the process of the whole stock processed in the low-consistency refiner In the above-mentioned alternatives, one step consists of a successive refiner and screen. The above-mentioned embodiments are described in detail below. The accept stock portions obtained at different stages of the process are combined and mixed, possibly bleached, and used as raw material for making paper in a paper machine. The machinery for preparing the stock may consist of several parallel processing lines, from which all the obtained accept stock portions are combined.

In the following the invention is explained in more detail with reference to FIGS. 1–5, which show schematic diagrams of the stock preparation process, all of which are different embodiments of the same invention.

Before feeding the chips into the process according to FIG. 1, the chips are pre-treated in hot steam under pressure, whereby the chips are softened. The pressure used in the pre-treatment is advantageously 50–800 kPa. Chemicals e.g. alkaline peroxide or sulphites, such as sodium sulphite, can also be used in the pre-treatment of the chips. Before the refiners there are also usually means for separating the steam, such as cyclones.

In the process according to FIG. 1, the chips are conveyed at a consistency of 40–60%, for example about 50%, to refiner 1, from which is obtained stock with a freeness value of 250–700 ml CSF. When spruce (*Picea abies*) is used as the raw material, the average fibre length after refiner 1 is not less than 2.0 mm. The pressure in refiner 1 is high, a superatmospheric pressure of more than 400 kPa (over 4 bar), advantageously 600–700 kPa. Superatmospheric pressure means pressure that is higher than normal atmospheric pressure. The refiner can be a conical or a disc refiner, advantageously a conical refiner. In comparison to a disc refiner, a conical refiner gives stock with a longer fibre length. The energy consumption of refiner 1 is 0.4–1.2 MWh/t.

The stock is fed via latency chest 2 to screen 3. In latency chest 2 the fibres that have become twisted during refining are straightened when they are kept in hot water for about an hour. The stock consistency in latency chest 2 is 1.5%.

From screen 3 is obtained the first accept stock portion A1, which has a freeness value of 20–50 ml CSF. The first reject stock portion R1 comprises 60–90%, advantageously about 80%, of the total stock. The first reject stock portion R1 is fed after water removal at a consistency of 30–60%, advantageously at a consistency of about 50%, to refiner 4 and from there onwards at a consistency off 1–5% to screen 5. The energy consumption of refiner 4 is 0.5–1.8 MWh/t.

From screen 5 is obtained the second accept stock portion A2 and the second reject stock portion R2, which comprises 60–80% of the stock R1 rejected at screen 5 in the previous stage. The second reject stock portion R2 is fed, at a consistency of 30–60%, advantageously at a consistency of 50%, to refiner 6 and from there onwards at a consistency of 1–5% to screen 7, from which are obtained the third accept stock portion A3 and the third reject stock portion R3, which is returned to the inlet of refiner 6. The energy consumption of the refiner is 0.5–1.8 MWh/t. The total stock, which is obtained by combining the accept stock portions A1, A2 and A3, has a freeness value of 30–70 ml CSF.

The above energy consumption values concerning the process according to FIG. 1 are the energy consumption when the chips have not been chemically treated, i.e. the pulp is TMP.

At refiners 4 and 6 the pressure can be high, at least over 400 kPa (over 4 bar), advantageously 600–700 kPa (6–7 bar), or it can be at a normal level, not more than 400 kPa, advantageously 300–400 kPa.

Water removal before the refiners in order to obtain a consistency of 30–60%, advantageously about 50%, is carried out with a screw press or similar means, which enables enough water to be removed from the process so that the above mentioned high consistency is obtained. Dilution of the stock before screening is carried out by pumping water into the process with a pump suitable for the purpose.

The stock is screened by known methods using, for example, a screen with a slotted sieve having a slot size of 0.10–0–20 mm and a profile height chosen to suit the screening situation and the desired result. In a process involving several screening stages, the size of the sieve slots generally increases towards the end of the process. The properties of the sieves must be chosen so that the screens do not get blocked in abnormal running situations, for example, when the process is started up. The consistency when using a slotted sieve is usually 1–5%

One possibility for screening the stock is a centrifugal cleaner, in which case the consistency must be regulated to be lower than when using a slotted sieve. When using a centrifugal cleaner the consistency is advantageously about 0.5%.

The ready-made stock, which has been obtained by combining and mixing the accept stock portions A1, A2 and A3, has a fibre distribution, measured by the Bauer-McNett method, as follows:

40–50% of the fibres do not pass through screens of 16 and 28 mesh,

15–20% of the fibres pass through screens of 16 and 28 mesh, but do not pass through screens of 48 and 200 mesh, and 35–40% of the fibres pass through screens of 48 and 200 mesh, i.e. these fibres go through all the screens used (–200 mesh).

The average fibre length of the fibres that are retained in the 16 mesh screen is 2.75 mm, that of fibres retained by the 48 mesh screen 1.23 mm and that of fibres retained in the 200 mesh screen 0.35 mm. (J. Tasman: The Fiber Length of Bauer-McNett Screen Fractions, TAPPI, Vol.55, No.1 (January 1972))

The stock thus obtained contains 40–50% of fibres with an average fibre length of over 2.0 mm, 15–20% of fibres with an average fibre length of over 0.35 mm, and 35–40% of fibres with an average fibre length of less than 0.35 mm.

Figure 2:
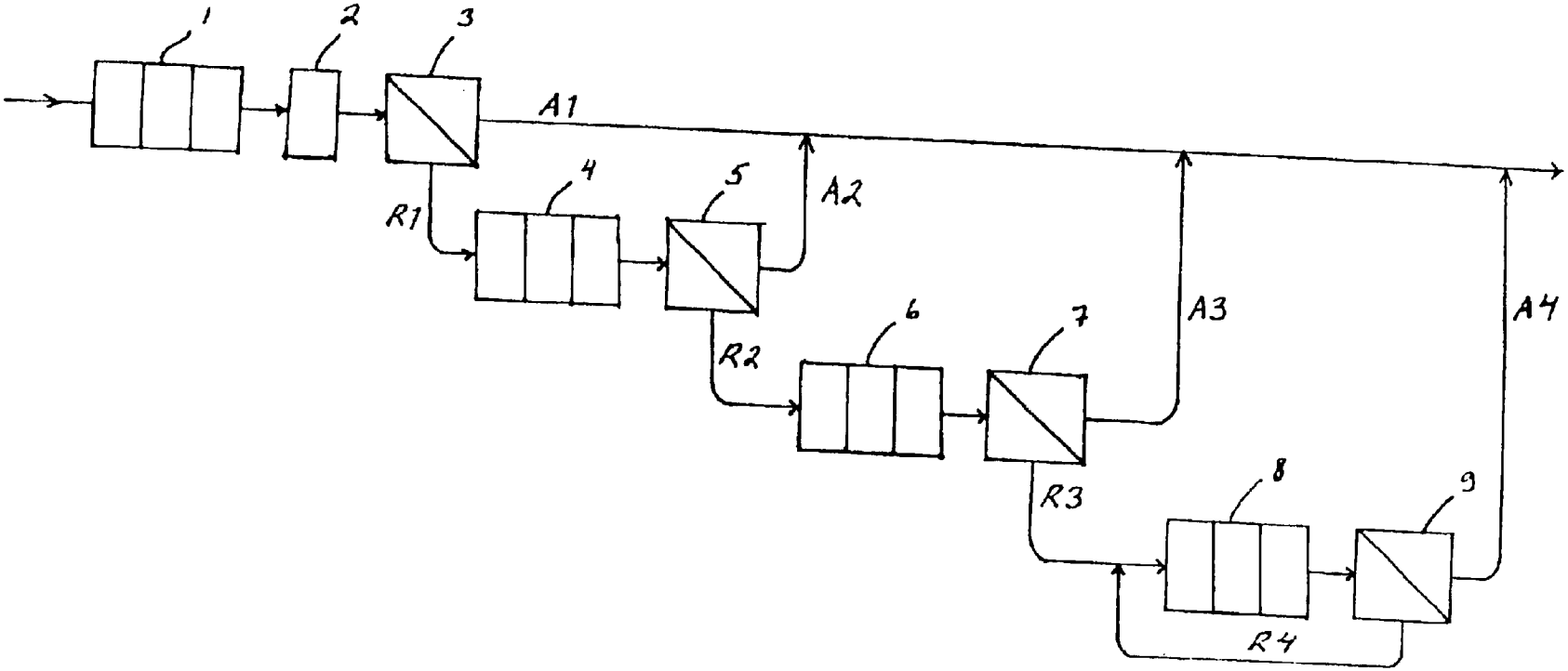

FIG. 2 shows another embodiment of the invention. The initial stage of the process is like the process shown in FIG. 1, but the third reject stock portion R3 is, instead, conveyed to refiner 8 and from there on to screen 9. The fourth accept stock portion A4, obtained from screen 9, is taken to be combined with the other accept stock portions A1, A2 and A3. The fourth reject stock portion R4 is returned to the inlet of refiner 8. This kind of arrangement may be necessary when aiming at a low freeness level, e.g. a level of 30 ml CSF.

Figure 3:
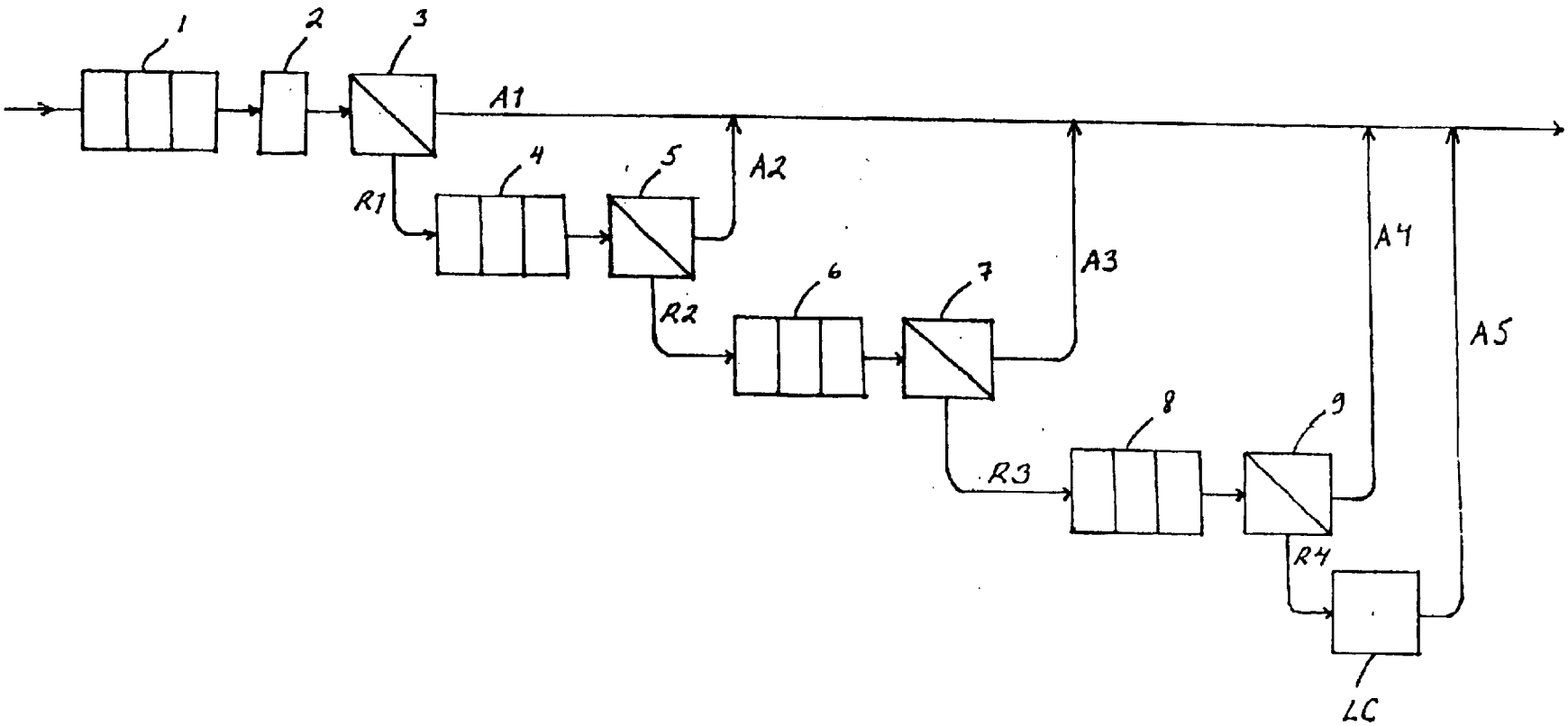

FIG. 3 shows a third embodiment of the invention. The initial stage of the process is like the process shown in FIG. 2, but the fourth reject stock portion R4 is conveyed to low-consistency-refiner LC. The consistency of the stock portion R4 fed into low-consistency-refiner LC is 3–5%. The accept stock portions A1, A2, A3, A4 and A5 obtained are combined and mixed to form a ready-made stock.

Figure 4:
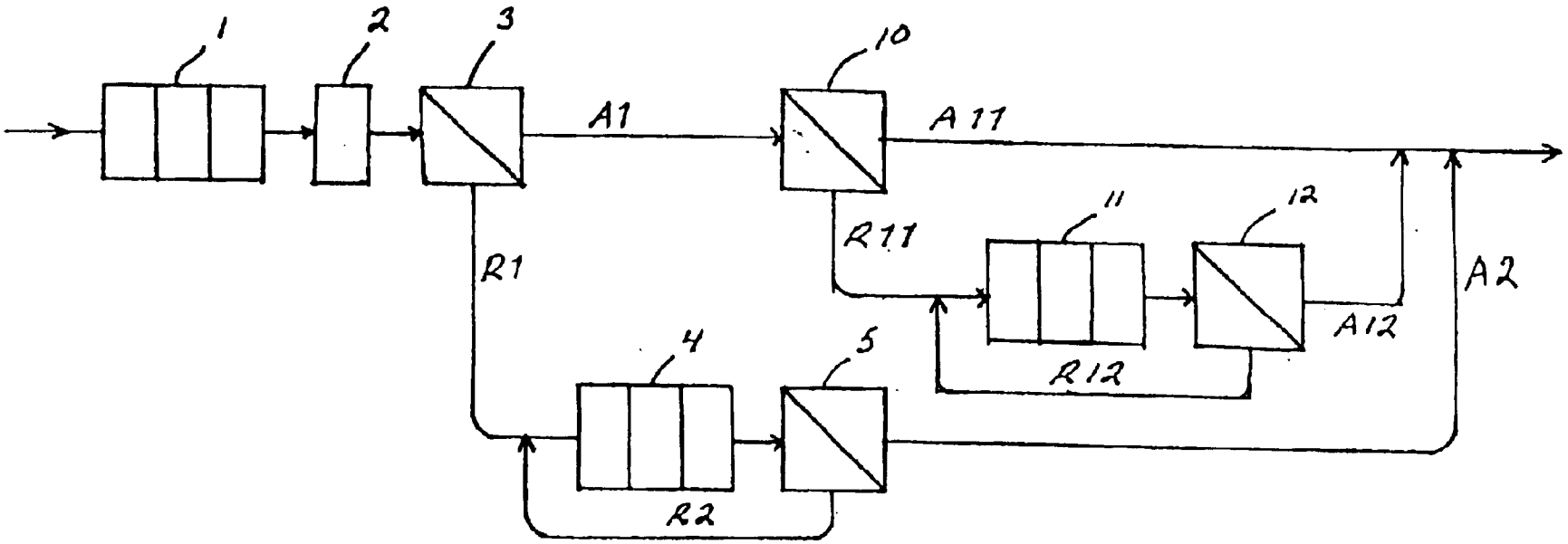

FIG. 4 shows a fourth embodiment of the invention. The reject stock portion R1 obtained from screen 3, is conveyed to refiner 4 and from there onwards to screen 5. The reject stock portion obtained from screen 5 is conveyed back to the inlet of refiner 4. The accept stock portion A2 obtained from screen 5 is taken out of the process.

The accept stock portion A1, obtained from screen 3, is conveyed for re-screening to screen 10. The accept stock portion A11 obtained from screen 10, is taken out of the process. The reject stock portion R11 obtained from screen 10 is conveyed to refiner 11 and from there on to screen 12. The reject stock portion R12, obtained from screen 12, is conveyed back to the inlet of refiner 11. The accept stock portion A12 obtained from screen 12, is taken out of the process to be combined with the other accept stock portions A11 and A2.

Figure 5:
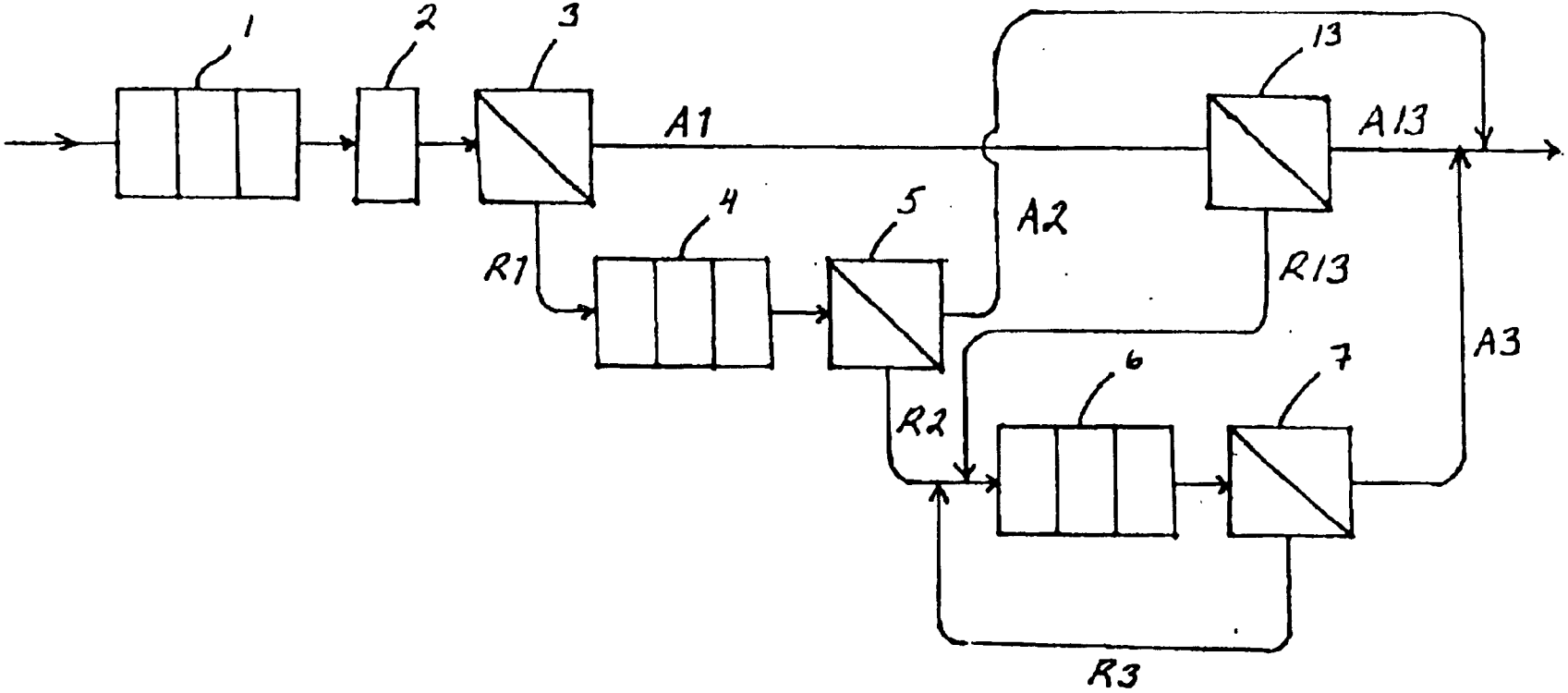

FIG. 5 shows a fifth embodiment of the invention. The process is otherwise like the process shown in FIG. 1, but the accept stock portion A1 obtained from screen 3 is conveyed for re-screening to screen 13. The accept stock portion A13 obtained from screen 13, the accept stock portion A2 obtained from screen 5 and the accept stock portion 3 obtained from screen 7, are combined and mixed together and conveyed to be used in the paper making process. The reject stock portion R13 obtained from screen 13 is combined with the reject stock portions R2 and R3, and the combined stock is conveyed to refiner 6.

The wood raw material used in the process can be any species of wood, but it is usually softwood, advantageously spruce, but e.g. pine and southern pine are also suitable wood raw materials for the purpose. When the wood raw material used is spruce and the chips have not been pretreated with chemicals, the energy consumption is approximately 2.8 MWh/t, of which about 0.3 MWh/t is used for regulating the stock consistency to be suitable for every stage of the process. Using the process shown in FIG. 1, the energy consumption at the first stage of refining is 0.4–1.2 MWh/t, at the second stage of refining 0.5–1.8 MWh/t, and at the third stage of refining 0.5–1.8 MWh/t. The required amount of energy is higher when processing pine than when processing spruce, e.g. processing southern pine requires approximately 1 MWh/t more energy than spruce. Also, changes in the size of chips affect energy consumption. The energy consumption rates mentioned above are calculated according to chip screening tests where the average length of a chip was 21.4 mm and the average thickness 4.6 mm.

In the following the properties of printing paper made from stock prepared according to the method of the invention are presented by way of examples. The methods used in testing the properties of the printing paper include the following:

| | |
|---|---|
| Freeness | SCAN-M 4:65 |
| Grammage | SCAN-C 28:76/SCAN-M 8:76 |
| Filler content | SCAN-P 5:63 (Paper and board ash) |
| Tensile strength | SCAN-P 38:80 |
| Internal bond | TAPPI Useful Method 403 (instructions for RD device) |
| Tensile index | SCAN-P 38:80 |
| Elongation | SCAN-P 38:80 |
| Tear index | SCAN-P 11:96 |
| Tear resistance | SCAN-P 11:96 |
| Bending resistance | Edana test (corresponds to BS 3356: 1982) |
| Bulk | SCAN-P 7:96 |
| Beta formation | Instructions for device |
| Standardised Beta formation | Instructions for device |
| Porosity | SCAN-P 60:87 |
| Bendtsen roughness | SCAN-P 21:67 |
| Opacity | SCAN-P 8:93 |
| ISO brightness | SCAN-P 3:93 |
| Y-value | SCAN-P 8:93 |
| Light absorption coefficient | SCAN-P 8:93 |
| Light scattering coefficient | SCAN-P 8:93 |
| PPS roughness | SCAN-P 76:95 |

EXAMPLE 1

Printing paper suitable for newsprint was manufactured in order to compare the properties of the end product. Sample 1 was manufactured from stock prepared according to the known method described at the beginning of the patent application, said stock containing 42% deinked pulp, and sample 2 was manufactured from primary fibre stock prepared according to the method of the invention. In sample 1, kaolin was used as the filler, in sample 2, powdered calcium carbonate was used as the filler. The results measured from the samples are shown in Table 1.

TABLE 1

The properties of uncalendered printing paper manufactured from the stock prepared according to a known method (sample 1) and the properties of uncalendered printing paper manufactured from stock prepared according to the invention (sample 2).

| Sample | | 1 | 2 |
|---|---|---|---|
| Freeness of stock (ml CSF) | | 61 | 50 |
| Sample from headbox | | | |
| Grammage (g/m$^2$) | | 40.0 | 37.7 |
| Filler content (%) | | 6.6 | 9.7 |
| Tensile strength (kN/m) | Average | 0.82 | 1.06 |
| | MD | 1.24 | 1.68 |
| | CD | 0.39 | 0.44 |
| Tensile strength ratio (MD/CD | | 3.32 | 3.23 |
| Internal bond (Scott Bond) | | 105 | 100 |
| Tear strength (mN) | Average | 208 | 223 |
| | MD | 138 | 143 |
| | CD | 278 | 302 |
| Bulk (cm$^3$/g) | | 2.66 | 2.66 |
| Beta formation (g/m$^2$) | | 3.1 | 2.7 |

TABLE 1-continued

The properties of uncalendered printing paper manufactured from the stock prepared according to a known method (sample 1) and the properties of uncalendered printing paper manufactured from stock prepared according to the invention (sample 2).

| Sample | | 1 | 2 |
|---|---|---|---|
| Standardised Beta formation | | 0.490 | 0.440 |
| Porosity (ml/min) | | 2292 | 1596 |
| Bendtsen roughness (ml/min) | Average | 879 | 909 |
| | Top surface | 941 | 823 |
| | Bottom surface | 817 | 995 |
| Opacity (%) | Average | 88.3 | 89.3 |
| | Top surface | 87.7 | 89.3 |
| | Bottom surface | 88.8 | 89.4 |
| ISO brightness (%) | Average | 64.2 | 62.3 |
| | Top surface | 64.5 | 62.6 |
| | Bottom surface | 63.8 | 62.0 |
| Y-value (%) | Average | 72.8 | 67.8 |
| | Top surface | 73.0 | 68.0 |
| | Bottom surface | 72.5 | 67.6 |
| Light absorption coefficient (m$^2$/kg) | Average | 3.4 | 4.4 |
| | Top surface | 3.2 | 4.4 |
| | Bottom surface | 3.5 | 4.5 |
| Light scattering coefficient (m$^2$/kg) | Average | 66.1 | 57.5 |
| | Top surface | 64.7 | 57.8 |
| | Bottom surface | 67.4 | 57.3 |

From the results it can be seen that good properties were achieved for the printing paper manufactured from the stock prepared according to the method of the invention, even though the grammage was lower and the filler content higher than in the reference sample.

Example 2

In order to compare the properties of calendered paper, samples were made from stock prepared by a known method and stock prepared by the method according to the invention.

TABLE 2

The properties of printing paper manufactured from the stock prepared according to a known method (sample 5) and printing paper manufactured from the stock prepared according to the invention (sample 6).

| Sample | | 5 | 6 |
|---|---|---|---|
| Grammage (g/m$^2$) | | 42.1 | 36.8 |
| Bulk (cm$^3$/g) | | 1.50 | 1.73 |
| PPS roughness (ml/min) | Top surface | 4.03 | 4.17 |
| | Bottom surface | 4.18 | 4.13 |
| Bendtsen roughness (ml/min) | Top surface | 131.5 | 119.0 |
| | Bottom surface | 140.5 | 128.5 |
| Porosity (ml/min) | | 262.0 | 686.0 |
| ISO brightness (%) | Top surface | 61.90 | 61.60 |
| | Bottom surface | 61.30 | 61.00 |
| Opacity (%) | Top surface | 89.30 | 91.00 |
| | Bottom surface | 89.10 | 90.40 |
| Y-value (%) | Top surface | 69.10 | 66.00 |
| | Bottom surface | 68.60 | 65.50 |
| Light scattering coefficient (m$^2$/kg) | Top surface | 61.40 | 60.60 |
| | Bottom surface | 59.10 | 57.60 |
| Light absorption coefficient (m$^2$/kg) | Top surface | 4.30 | 5.30 |
| | Bottom surface | 4.20 | 5.30 |
| Tensile index (Nm/g) | MD | 43.1 | 50.7 |
| | CD | 12.0 | 11.6 |
| Elongation (%) | MD | 0.82 | 0.99 |
| | CD | 22.33 | 2.25 |
| Tensile strength (kN/m) Machine direction | | 2.42 | 1.87 |
| Tear index (mNm$^2$/g) | MD | 3.85 | 3.52 |
| | CD | 5.67 | 6.74 |

TABLE 2-continued

The properties of printing paper manufactured from the stock prepared according to a known method (sample 5) and printing paper manufactured from the stock prepared according to the invention (sample 6).

| Sample | | 5 | 6 |
|---|---|---|---|
| Tear strength (mN) | | 260.82 | 248.33 |
| Cross direction | | | |
| Bending resistance (mm) | MD | 60 | 58 |
| | CD | 37 | 31 |

From the results it can be seen that good properties were achieved for the printing paper manufactured from the stock prepared according to the method of the invention, even though the grammage was lower than in the reference sample.

The above does not limit the invention but the scope of protection of the invention varies within the patent claims. The invention is not limited as regards the wood raw material to the tree species mentioned, but other tree species can be used, although, for example, the energy consumption of the process and the average fibre length obtained vary depending on the wood raw material. The same stock can contain fibres from different tree species.

The method for preparing stock may vary after the first stage of refining. The stock can be used for producing various types of printing paper. The core idea of the invention is that the stock refined by a certain new method, is suitable as a raw material for printing papers and makes it possible to produce printing paper more cost-efficiently than before.

What is claimed is:

1. A method for producing thermomechanical and chemi-thermomechanical pulp effective for use as a raw material for printing paper, the method comprising:

refining wood raw material in a first refining stage at a superatmosperic pressure of greater than 400 kPa, the first refining stage effective for forming a first refined stock with a freeness value of 250 to 700 ml CSF;

screening the first refined stock into a first accept and first reject portion;

refining and screening the first reject portion in at least one additional stage into accept and reject stock portions; and combining the first accept stock portion and accept stock portions to form a ready made stock, the time and temperature of the first refining step being effective for providing the ready made stock with 40 to 50% of fibers not passing through screens of 16 and 28 mesh and 35–40% of fibers passing through screens of 48 and 200 mesh and wherein the ready made stock has a freeness value of 30 to 70 ml CSF.

2. The method of claim 1, wherein the wood raw material is refined at a superatmospheric pressure of 600 to 700 kPa.

3. The method of claim 2, wherein the refining takes place at a temperature of 165° C. to 175° C.

4. The method of claim 3, wherein the freeness value of the first accept stock portion is 20 to 50 ml CSF.

5. The method of claim 3, wherein the first accept stock portion is taken out of the process.

6. The method of claim 5, wherein the first accept stock portion is re-screened to form a secondary accept stock portion and a secondary reject stock portion.

7. The method of claim 6 wherein the secondary accept stock portion is taken out of the process.

8. The method of claim 6 wherein the secondary reject stock portion is conveyed to refining after the first refining, after which it is screened to form a third accept stock portion and a third reject stock potion.

9. The method of claim 8 wherein the third accept stock potion is taken out of the process.

10. The method of claim 8 wherein the third reject portion is conveyed back to refining after the first refining.

11. The method of claim 3 wherein the first accept stock portion is re-screened.

12. The method of claim 11, wherein the first accept stock portion is screened so as to form a secondary accept stock portion and a secondary reject stock portion.

13. The method of claim 12, wherein the secondary accept stock portion is taken out of the process.

14. The method of claim 12, wherein the secondary reject stock portion is fed into a third refining stage.

15. The method of claim 3, wherein the first reject stock potion comprises 60 to 90% by weight of the stock in the screening.

16. The method of claim 3, wherein the first reject stock portion is conveyed to a second stage of refining from which stock is screened to a second accept stock portion and a second reject stock potion.

17. The method of claim 16, wherein the second accept stock portion is taken out of the process.

18. The method of claim 16, wherein the second reject stock portion comprises 60 to 80% by weight of the stock in the second screening.

19. The method of claim 16, wherein the second reject stock portion is conveyed back into the second refining stage.

20. The method of claim 16, wherein the second reject stock portion is taken to the third refining stage and the stock obtained from said third refining stage is screened so as to form a third accept stock portion and a third reject stock potion.

21. The method of claim 20, wherein the third reject stock portion is conveyed back to the third stage of refining.

22. The method of claim 20, wherein the third accept stock portion is taken out of the process.

23. The method of claim 22, wherein the secondary accept stock portion and the third accept stock portions are combined and mixed to form a ready-made stock.

24. The method of claim 22, wherein the first accept stock portion, the second accept stock portion, and the third accept stock portion are combined and mixed to form a ready-made stock.

25. The method of claim 22, wherein the second accept stock portion, secondary accept stock portion and the third accept portion are combined and mixed to form a ready-made stock.

26. The method of claim 20, wherein the third reject stock portion is conveyed to a fourth phase of refining, and the stock from said fourth stage of refining is screened to form a fourth accept stock and fourth reject stock.

27. The method of claim 26, wherein the fourth accept stock is taken out of the process.

28. The method of claim 27, wherein the first accept stock portion, second accept stock portion, third accept stock portion and fourth accept stock portion are combined and mixed to form a ready-made stock.

29. The method of claim 26, wherein the fourth reject stock is conveyed back into the fourth phase of refining.

30. The method of claim 26, wherein the fourth reject stock portion is conveyed to a low-consistency refiner.

31. The method of claim 30, wherein a fifth accept stock portion refined in the low-consistency refiner, is taken out of the process.

32. The method of claim 31, wherein a first accept stock portion, a second accept stock portion, a third accept stock portion, a fourth accept stock portion and a fifth accept stock portion are combined and mixed to form a ready-made stock.

33. The method of claim 32, wherein the stock consistency during screening is 0.5 to 5%.

34. The method of claim 32, wherein the stock consistency during refining is 30 to 60%.

35. A method for producing thermomechanical and chemi-thermomechanical pulp effective for use as a raw material for printing paper, the method comprising:

refining wood raw material in a first refining stage at a superatmosperic pressure of greater than 400 kpa, a temperature of from 165° C. to 175° C. and an average time of not more than 10 seconds, the first refining stage effective for forming a first refined stock with a freeness value of 250 to 700 ml CSF;

screening the first refined stock into a first accept and first reject portion;

refining and screening the first reject portion in at least one additional stage into accept and reject stock portions; and combining the first accept stock portion and accept stock portions to form a ready made stock, wherein the ready made stock has a freeness value of 30 to 70 ml CSF.

36. The method as recited in claim 35 wherein the pressure, temperature and average time of each of the refining steps are effective to provide the ready made stock with 40 to 50% of the fibers do not pass through screens of 16 and 28 mesh and 35–40% of the fibers pass through screens of 48 and 200 mesh.

37. The method of claim 36, wherein the wood raw material is refined at a superatmospheric pressure of 600 to 700 kPa.

38. The method of claim 37, wherein the freeness value of the first accept stock portion is 20 to 50 ml CSF.

39. The method of claim 38, wherein the first reject stock portion comprises 60 to 90% by weight of the stock in the screening.

40. The method of claim 36, wherein the first reject stock portion is conveyed to a second stage of refining from which stock is screened to a second accept stock portion and a second reject stock portion.

* * * * *

UNITED STATES PATENT AND TRADEMARK OFFICE

CERTIFICATE OF CORRECTION

PATENT NO. : 6,878,236 B2
DATED : April 12, 2005
INVENTOR(S) : Taisto Tienvieri et al.

It is certified that error appears in the above-identified patent and that said Letters Patent is hereby corrected as shown below:

Column 10,
Lines 4, 6, 19, 24 and 35, change “potion” to -- portion --.

Signed and Sealed this

Twenty-seventh Day of December, 2005

JON W. DUDAS
*Director of the United States Patent and Trademark Office*